US005644076A

United States Patent [19]

Proett et al.

[11] Patent Number: 5,644,076

[45] Date of Patent: Jul. 1, 1997

[54] WIRELINE FORMATION TESTER SUPERCHARGE CORRECTION METHOD

[75] Inventors: Mark A. Proett; Margaret C. Waid; Wilson C. Chin, all of Houston, Tex.

[73] Assignee: Halliburton Energy Services, Inc., Houston, Tex.

[21] Appl. No.: 614,617

[22] Filed: Mar. 14, 1996

[51] Int. Cl.[6] ..... E21B 49/00; E21B 47/00

[52] U.S. Cl. ..... 73/152.41; 324/324; 324/367; 175/48; 175/50; 166/100; 166/250.02; 166/250.07; 73/152.17; 73/152.26; 73/152.05

[58] Field of Search ..... 73/155, 152, 152.41, 73/152.39, 152.26, 152.381, 152.171, 152.05, 152.02; 324/367, 324; 175/48, 50; 166/264, 100, 250

[56] References Cited

U.S. PATENT DOCUMENTS

| | | | |
|---|---|---|---|
| 3,811,321 | 5/1974 | Urbanosky | 73/155 |
| 4,745,802 | 5/1988 | Purfurst | 73/155 |
| 4,951,749 | 8/1990 | Carroll | 166/264 |
| 5,056,595 | 10/1991 | Desbrandes | 166/100 |
| 5,230,244 | 7/1993 | Gilbert | 73/155 |
| 5,233,866 | 8/1993 | Desbranes | 73/155 |
| 5,269,180 | 12/1993 | Dave et al. | 73/152 |
| 5,335,542 | 8/1994 | Ramakrishnan et al. | 73/152 |
| 5,473,939 | 12/1995 | Leder et al. | 73/155 |
| 5,477,922 | 12/1995 | Rochon | 166/250.02 |
| 5,503,001 | 4/1996 | Wong | 73/38 |

*Primary Examiner*—Hezron E. Williams
*Assistant Examiner*—J. David Wiggins

[57] ABSTRACT

An improved formation testing method increases the accuracy of in-situ formation pressure measurements by characterizing the mudcake properties. Specifically, after a formation tester is lowered to a desired depth within a wellbore, a pad is extended to gently abut and seal against the mudcake without disturbing the mudcake. When pressed against the mudcake, the pad experiences momentarily higher pressures, which are measured by a probe housed by the pad. These pressures may be enhanced by briefly rejecting fluids through the probe, so as to avoid disturbing the mudcake. The probe continues to measure pressure, which eventually decreases relative to hydrostatic pressure in the wellbore, due to the flow of high-pressure wellbore fluids through the mudcake. Since the rate of fluid flow outward into the formation is governed by the permeability of the mudcake, measuring the rate of pressure decline during this initial period provides useful data to more accurately estimate properties such as formation compressibility. Additionally, indicia of the mudcake properties themselves may be generated. After the initial mudcake tests, the formation tester may be used to perform drawdown and/or buildup tests, by a process of withdrawing or injection fluids into the formation through the mudcake.

24 Claims, 8 Drawing Sheets

WIRELINE FORMATION TESTER SUPERCHARGE CORRECTION METHOD

BACKGROUND OF INVENTION

1. Field of Invention

This invention concerns a system for conducting wireline formation testing. More particularly, the invention concerns an improved wireline formation testing method that characterizes mudcake properties and more accurately measures formation characteristics such as compressibility by monitoring fluid seepage through the mudcake prior to any drawdown or buildup sequences. The method of the invention may be especially advantageous for application in supercharged regions.

2. Description of Related Art

Due to the increasing costs associated with drilling oil wells, and due to the increasing availability of "high-tech" well analysis systems, wireline well logging ("wireline logging") has become an important technique to optimize the productivity of oil wells. Generally, in wireline logging, a sensitive measuring instrument is lowered down a wellbore, and measurements are made at different depths of the well. The measuring instrument may take various forms as required, for example, to perform electrical logs, nuclear logs, and formation pressure testing logs. Electrical logs are typically used to locate hydrocarbon reserves. In contrast, nuclear logs are employed to determine the volume of hydrocarbons in the reserves, typically by determining the porosity of the materials in reserves identified by the electrical logs. In contrast to electrical and nuclear logs, formation pressure testing logs ("formation testing logs") are used to determine the mobility of the reserves, chiefly by determining their pressure and permeability.

A wellbore is typically filled with a drilling fluid such as water or a water-based or oil-based drilling fluid. The density of the drilling fluid is usually increased by addingcertain types of solids that are suspended in solution. Drilling fluids containing solids are often referred to as "drilling muds." The solids increase the hydrostaticpressure of the wellbore fluids to help maintain the well and keep fluids of surrounding formations from flowing into the well. Uncontrolled flow of fluids into a well can sometimes result in a well "blowout."

Drilling fluids create a "mudcake" as they flow into a formation by depositing solids on the inner wall of the wellbore. The wall of the wellbore tends to act like a filter. The mudcake helps prevent excessive loss of drilling fluid into the formation. The static pressure in the well bore and the surrounding formation is typically referred to as "hydrostatic pressure." Relative to the hydrostatic pressure in the wellbore, the hydrostatic pressure in the mudcake decreases rapidly with increasing radial distance. Pressure in the formation beyond the mudcake gradually tapers off with increasing radial distance outward from the wellbore.

As shown in FIG. 1, pressure is typically distributed in a wellbore through a formation as shown by the pressure profile 100. Pressure is highest at the wellbore's inner wall, i.e., the inside surface of the mudcake at point 102. The mudcake acts like a filter, restricting the flow of fluids from the high pressure of the wellbore into the relatively lower pressure of the formation. Thus, there is a rapid pressure drop through the mudcake. The pressure at point 104 at the interface between the mudcake and the formation (the "sandface pressure") is substantially lower than the pressure at point 102 at the inside surface of the mudcake. Conventional mudcakes are typically between about 0.25 and 0.5 inch thick, and polymeric mudcakes are often about 0.1 inch thick. Beyond the mudcake, the formation exhibits a gradual pressure decrease illustrated by the slope 106 and asymptotically approaching formation pressure 109. Curve 107 depicts a pressure profile of highly supercharged well with a low permeability mudcake and high sandface pressure 108.

With this type of knowledge, formation testing tools ("formation testers") maybe used to predict the pressure of an oil bearing formation around a well, and to thereby better understand the oil's mobility. In a typical formation testing operation, a formation tester 200 is lowered into a wellbore 202 with a wireline cable 201, as illustrated in FIG. 2A. Inside the wellbore 202, the formation tester 200 resides within drilling fluid 204. The drilling fluid 204 typically forms a layer of mudcake 206 on the wails of the wellbore 202, in accordance with known techniques. In many cases, additioinal logging tools (not shown) for conducting other types of logs, such as gamma ray logs, may be included as part of a tool stiring attached to the same wireline cable and may be located above or below formation tester 200 in the tool string.

After the formation tester 200 is lowered to the desired depth of the wellbore 202, along with any other equipment connected to the wireline cable 201, pressure in a flow line 219 is equalized to the hydrostatic pressure of the wellbore by opening an equalization valve 214. Since the equalization valve 214 is located at a high point of the tester 200, openingthe valve 214 permits bubbles and lighter fluids to escape out into the wellbore 202 through the flow lines 215. Then, a pressure sensor 216 may be used to measure the hydrostatic pressure of the drilling fluid. In the illustrated embodiment, the equalization valve 214 is a two-way valve that simply enables or disables fluid flow through the flow lines 215.

After the equalization valve 214 is again closed, the tester 200 is secured in place by extending hydraulically actuated feet 208 and an opposing isolation pad 210 against opposite sides of the wellbore walls. The pad 210 surrounds a hollow probe 212 (sometimes called a "snorkel"), which is connected to plumbing internal to the tester 200, as described below. Initially, as the pad 210 is extended against the wellbore wall, the pressure inside the probe 2 12 slightly increases.

Fluid from the formation 222 is drawn into the tester 200 by mechanically retracting a pretest piston 218. The retracting of the protest piston 218 creates a pressure drop at the probe 212, thereby drawing formation fluid into the probe 212, the flow lines 219, and a protest chamber 220. The isolation pad 210 helps prevent borehole fluids 204 from flowing outward through the mudcake 206 and circling back into the probe 212 and the chamber 220. Thus, the isolation pad 210 "isolates" the probe 212 from the borehole fluids 204, helping to ensure that the measurements of the probe 212 are representative of the pressure in the formation 222. When the piston 218 stops retracting, formation fluid continues to enter the probe 212 until the pressure differential between the chamber 220 and the formation 222 is minimized.

During the process described above, a number of measurements may be taken. "Drawdown pressure", for example, corresponds to the pressure detected by the sensor 216 while formation fluid is being withdrawn from the formation. In addition, the "buildup pressure" corresponds to the pressure detected while formation fluid pressure is building up again after the drawdown period, i.e., soon after the pretest piston 218 stops moving. Also, the rate at which the piston 218 is retracted may be measured. Furthermore, if further fluid samples are desired in addition to the fluid in the chamber 220, control valves 224 may be individually opened and closed at selected times to capture fluid samples in supplemental chambers 226.

After the desired measurements are made, the formation tester 200 may be raised or lowered to a different depth to take another series of tests. At each depth, the tests usually require a short period of time, such as five minutes. Later, the fluid samples are examined and the measured fluid pressures are analyzed to determine the fluid mobility, as influenced by factors such as the porosity and permeability of adjacent formation.

Normally, the mudcake acts like a filter, largely isolating the high pressure fluids of the wellbore from the relatively lower pressures of the formation. Under these circumstances, the formation pressure tester will detect pressure as shown by the curve 300 illustrated in FIG. 3. Initially, as shown by the portion 301 of the curve 300, pressure at the probe decreases rapidly as the mudcake is sucked into the probe during the "drawdown" period. As shown by the portion 302 of the curve 300, the pressure eventually normalizes (302) as the probe removes fluids from locations that are more and more distant from the wellbore. When the protest piston 218 stops, fluid pressure is allowed to build up again (303), and pressure increases and eventually normalizes to a value corresponding to the formation pressure (304).

Although conventional formation testing systems have been satisfactory in many applications, they are limited when considered for certain measurements. For example, despite the use of the isolation pad 210, during formation testing a significant amount of fluid often flows out into the formation 222 from the wellbore proximate the pad 210, and is thereafter sucked back into the probe 212. This phenomenon is due, at least in part, to the permeability of the mudcake, which allows fluid flow through the mudcake. However, in measuring formation pressure and related parameters, known formation testing techniques fail to compensate for this phenomenon. Therefore, measurements taken with known methods may not be as accurate as some people might require, since they,fail to take into account, the permeability of the mudcake.

Known methods disregard the effect of the mudcake. In one popular technique, for example, the probe is specifically operated to clean away the mudcake to achieve a more effective seal with the formation. This may be performed, for example, by rapidly withdrawing the piston to suck nearby mudcake into the probe, or by extending a pad-cleaning piston (not shown) to perforate the mudcake. In another example, the probe is surrounded by a circular metal ring (not shown) which, in many cases, has the effect of puncturing or entirely removing the mudcake proximate the probe. In this method, the characteristics of the mudcake are clearly not measured, since the mudcake is often effectively removed.

In another technique, two drawdown, cycles are performed—the first cycle establishes a hydraulic seal between the probe and the formation, and the second cycle tests the pressure of the formation. The timing and intensity of suction applied in the first cycle of this method often dislodges or damages the the mudcake near the probe.

Another problem with conventional formation testing systems is that they are not as accurate as some people might desire when used in "supercharged regions." In a supercharged region, the mudcake fails to adequately hold the drilling fluid in the wellbore, and the drilling fluid penetrates the formation creating an "invaded zone." In the invaded zone, the fluid pressure is increased. The effect of supercharging on the operation of a formation pressure tester is illustrated by the curve 305 in FIG. 3. With supercharging, the pressure detected by the formation tester is, initially higher (306) than without supercharging. During drawdown, as the pretest piston 218 retracts, the pressure rapidly decreases (307), but normalizes at a level (308) greater than the non-supercharged formation pressure (302). When the pretest piston 218 stops, fluid pressure rapidly builds up again (309), and pressure increases and eventually normalizes to a value (310) corresponding to the supercharged formation pressure. When the formation pressure testing tool is disengaged from the wellbore, the detected formation pressure rises again (312). This final pressure increase occurs due to the removal of pressure applied by the pad 210.

There are two mechanisms that cause the flow of formation fluid into the probe 212 in the buildup state. First, the compressibility of the fluid in the formation 222 creates a pressure differential between the probe 212 and the formation pressure. The second mechanism is the compressibility of the fluid in the flow line 219 in contact with,the probe 212. This fluid is decompressed, creating an additional pressure differential between the probe 212 and the formation 222. However, many conventional analysis technique ignore these mechanisms, assuming that the wellbore pressure is isolated from the formation near the probe and that little or no fluid flows across the mudcake. As discussed above, fluid how across the Wellbore boundary may be significant due to the, permeability of the mudcake, and such flow may be especially acute in supercharged regions. Therefore, known methods for measuring formation pressure are not as accurate as some people would, like; especially, when applied in supercharged regions.

Some known methods attempt to compensate for the distorting effect of supercharging by measuring formation pressure at various depths and by making estimations based on deviations from a linear pressure relationship. Although this approach might, be adequate for some applications, it is limited because it fails to actually quantify the effect of supercharging, and therefore lacks the level of accuracy some people require.

The present invention is directed to overcoming or minimizing one or more of the problems mentioned above.

SUMMARY OF INVENTION

The present invention is especially concerned with the nature of the mudcake and its influence over flow conditions between the wellbore and the formation. In accordance with the invention, it has been noted that immediately following the initial impact of the pad against the wall of a well, before any drawdown or buildup sequence, the pressure detected at the probe first rises and then falls. The pressure rise that occurs when the pad of the formation tester is pressed against the wall of a well appears to result from the mechanical pressure exerted by the pad itself. The fall in pressure, on the other hand, appears the caused by a shielding action on the part of the pad. The pad is considered to shield the portion of a formation covered by the pad from the seepage of wellbore fluids outward into the formation via the mudcake. The pressure within the shielded portion of the formation then, eventually exhibits a reduced pressure with respect to the pressure detected when the pad is first applied to the wall of the wellbore.

In accordance with the invention, the magnitude of this fall may be enhanced by injecting a small amount of fluid into the formation through the probe soon after the pad impacts the wellbore's wall. This rise and fall effect has been found to provide valuable insight into the properties and influence of the mudcake layer on the flow characteristics of a formation. This information is especially useful in more accurately analyzing the results of conventional buildup and drawdown operations.

BRIEF DESCRIPTION OF DRAWINGS

The nature, objects, and advantages of the invention will become more apparent to those skilled in the art after considering the following detailed description in connection with the accompanying drawings, in which like reference numerals designate like parts throughout, wherein.

FIG. I is a graph illustrating the relationship between pressure and radial distance from the wellbore.

DESCRIPTION OF A PREFERRED EMBODIMENT

The present invention, in an illustrative embodiment, may be carried out using various known wireline formation testers. For example, the invention may advantageously employ certain tools, such as the Sequential Formation Tester ("SFT") series tools, or the Hybrid Multi-Set Tester ("HMST") series tools; available from Halliburton.

Figure 1:
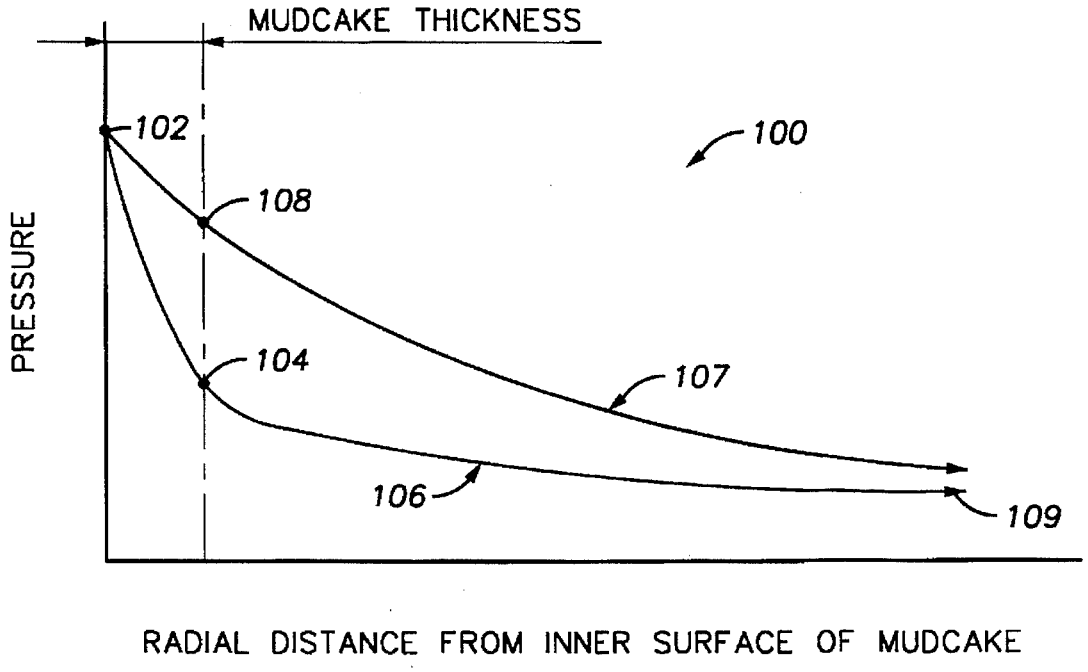
Figure 3:
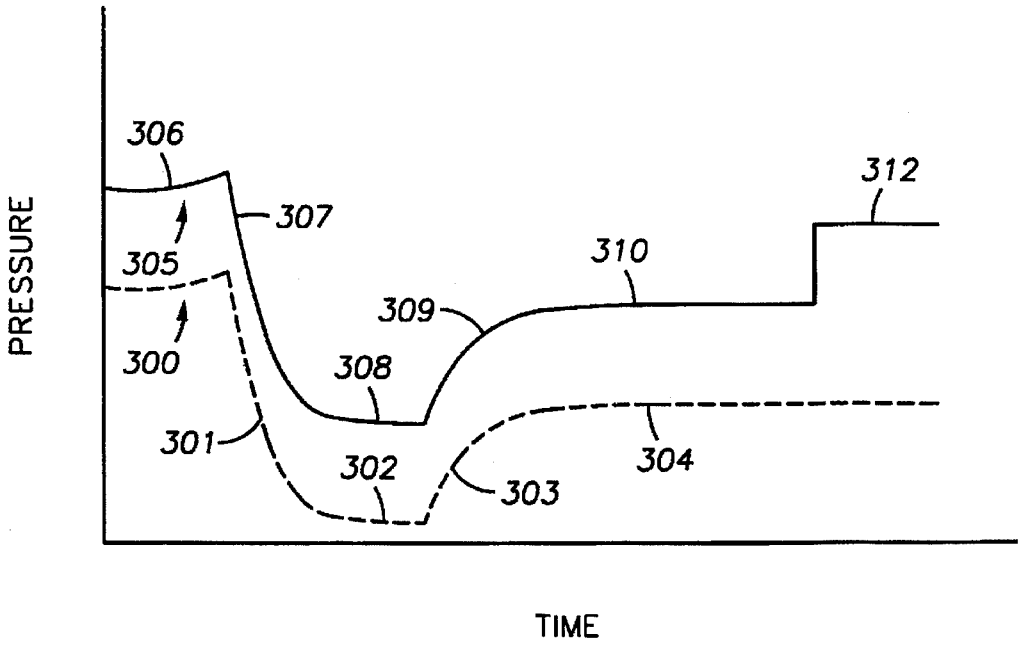
FIG. 3 is a graph contrasting pressures detected by a formation tester in a supercharged region and a non-supercharged region over a period of time.
Figure 2A:
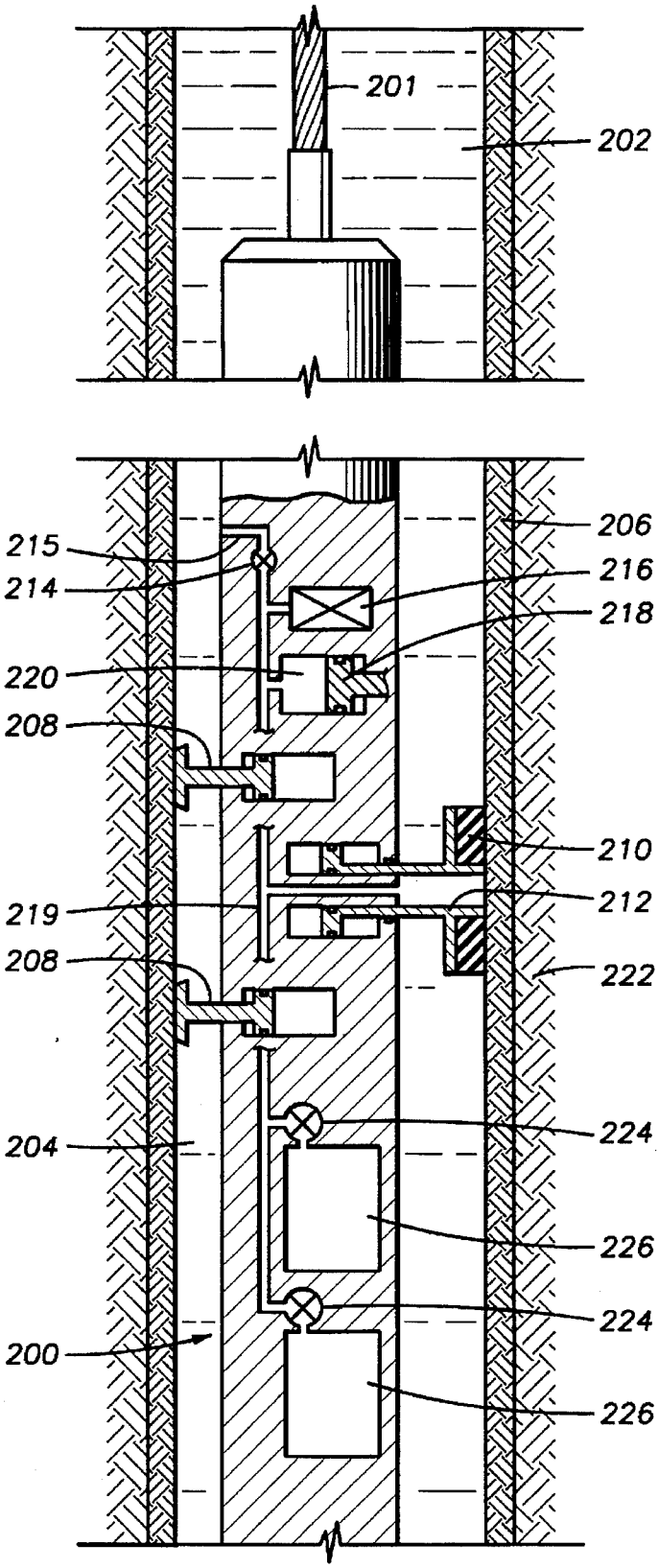
FIG. 2A (PRIOR ART)
FIG. 2A is a diagram illustrating a known wireline formation tester.
Figure 2B:
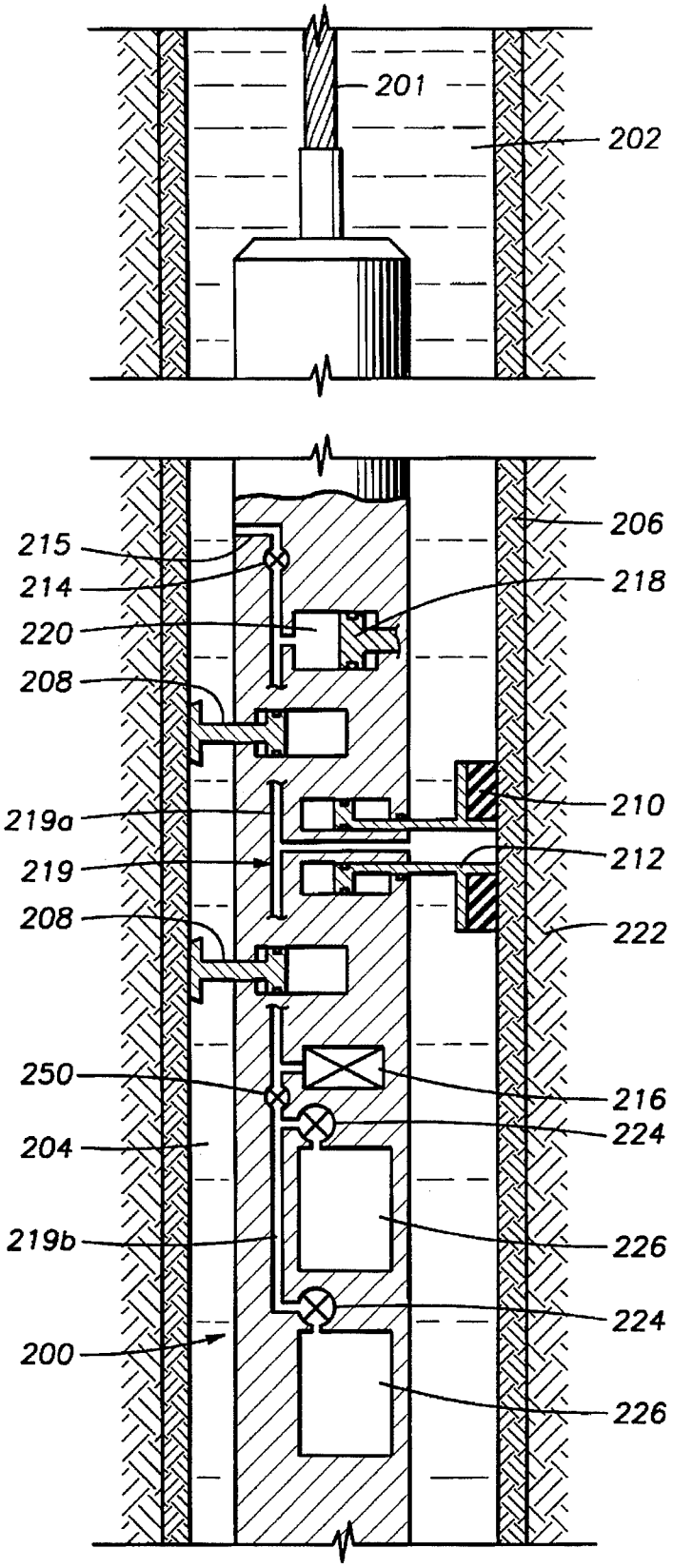
FIG. 2B is a diagram illustrating an improved wireline formation tester in accordance with the present invention.

In an exemplary embodiment, the invention may be carried out with an improved formation tester, such as shown in FIG. 2B. The formation tester of FIG. 2B resembles that of FIG. 2A, with the addition of certain improvements. Namely, a master valve 250 is included to reduce selectively the volume of the flow line 219 by isolating the pressure sensor 216 and the chamber 226 from the probe 212 and the chamber 220. This effectively divides the flow line 219 into an upper flow line 219*a* and a lower flow line 219*b*. Such isolation may ba useful, for example, to decrease the buildup time by effectively decreasing the flow line volume of the tester 200 during buildup. Furthermore, decreasing the flow line volume also reduces pressure measurement errors resulting from the compressibility of the fluid in the flow line 219. This phenomenon is known as the "flow line storage effect."

The tester 200 of the invention is also different from prior arrangements in that the tester 200 is carefully constructed so that the probe 212 and pad 210 do not contain any sharp points or ridges that may damage the mudcake when the pad 210 is extended.

Figure 4:
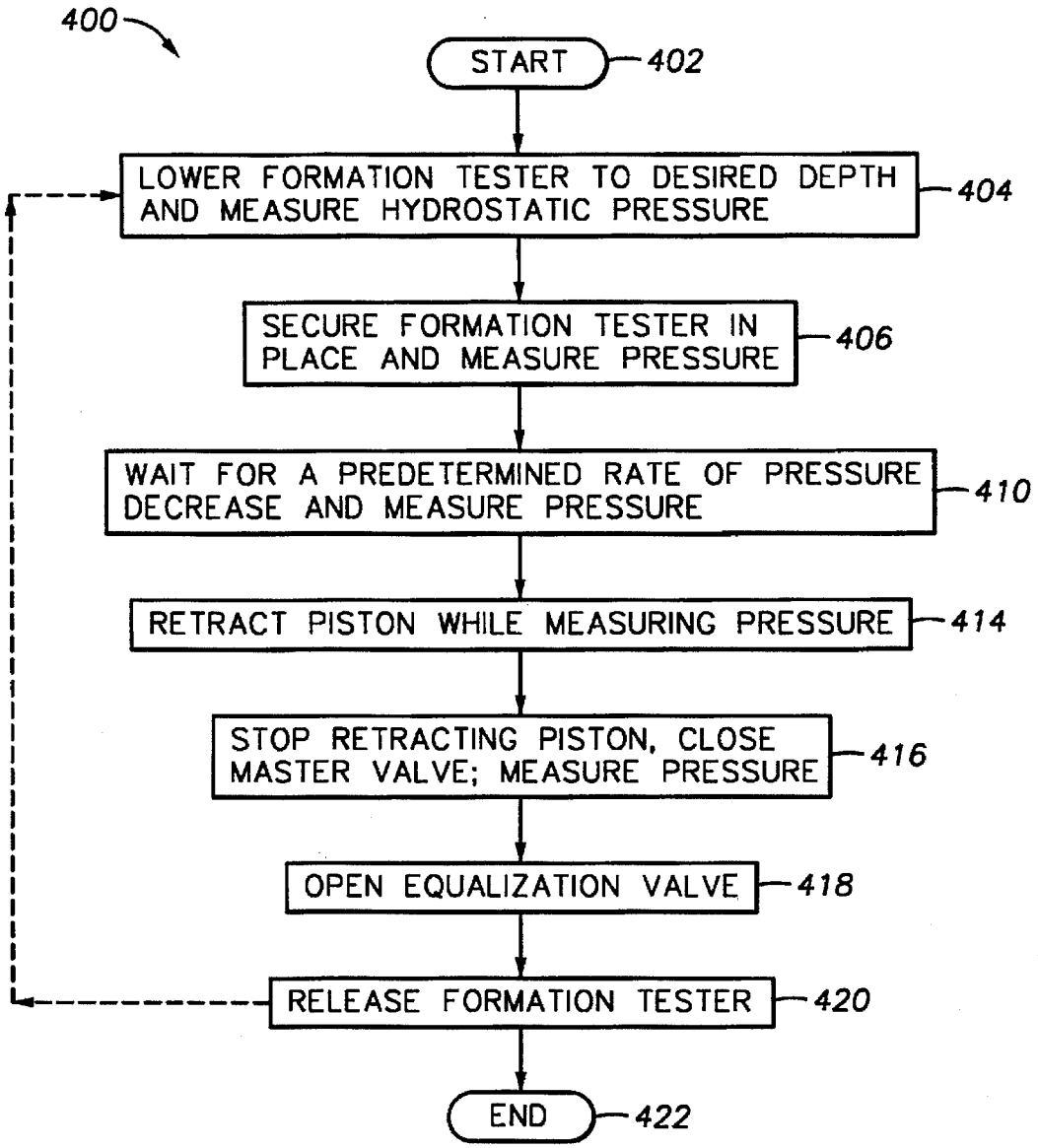
FIG. 4 is a flowchart illustrating a routine for measuring formation pressure in accordance with the present invention.

The method of the present invention may be carried out with a number of tasks, such as the routine 400 illustrated in FIG. 4. Pressure levels 500 corresponding to the routine 400 will be explained with reference to FIG. 5. The routine 400 is initiated in task 402, preferably after conducting and analyzing electrical and/or nuclear logs to identify certain formations for which pressure data is required. After task 402, task 404 lengthens the wireline cable 201 downhole to lower the formation tester 200 into the wellbore 202. Generally, the wireline cable 201 carries a number of electrical signals, including the large voltage needed to power the downhole tools attached to the cable 201. In the case of the wireline formation tester 200, the voltage from the cable 201 powers the hydraulically actuated feet 208, which typically require about 500 volts A.C.

Figure 5:
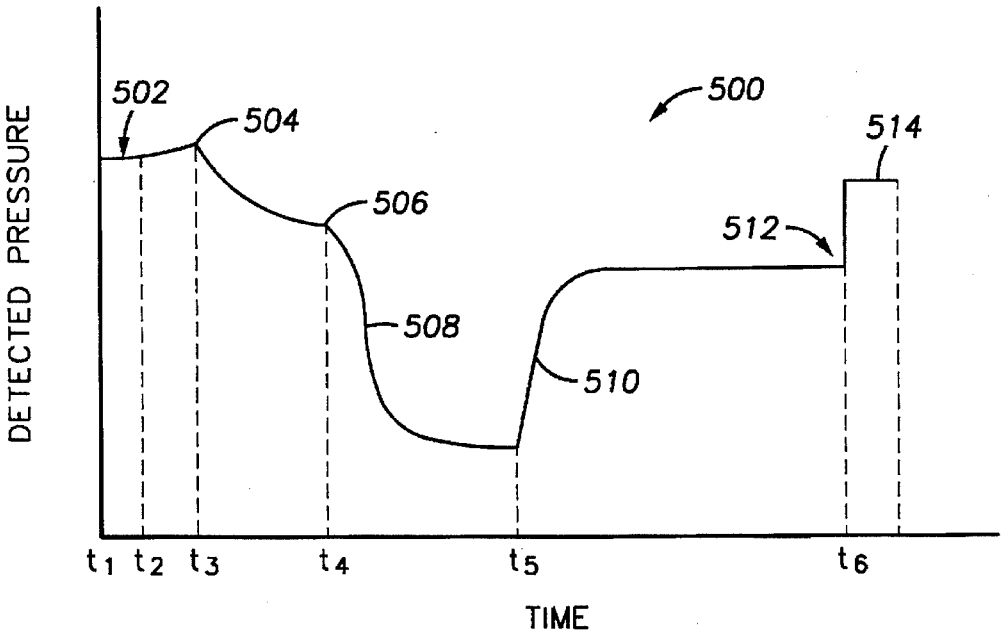
FIG. 5 is a graph illustrating the pressure detected by a formation tester during formation testing conducted in accordance with the routine of the present invention.

After the formation tester 200 has been lowered to the desired depth, along with any other equipment connected to the wireline cable 201, the tester 200 in task 404 measures the hydrostatic pressure of the wellbore fluid 204. The measured hydrostatic pressure of the wellbore is illustrated in FIG. 5 as a level 502, which is measured at a time $t_1$. As explained in more detail below, the tester 200 is initially operated with the equalization valve 214 and the master valve 250 open.

Next, in task 406, the formation tester 200 is secured in place. Specifically, the tester 200 is secured by extending the hydraulically actuated feet 208 and the opposing isolation pad 210 against opposite regions of the wellbore wall. The isolation pad 210 sealingly engages the mudcake 206 and provides a hydraulic seal around the probe 212. Task 406 is performed at a time $t_2$, which may occur, for example, about one minute after the time $t_1$. As shown in FIG. 5, pressure rises due to this compression, as the pad 210 presses against the wellbore's wall and spreads out. When the pad 210 is fully compressed, the probe 212 detects an increased pressure corresponding to a level 504, occurring at a time 13. The pressure, in an illustrative embodiment, may reach the peak level 504 about five minutes after the full extension of the feet 208.

Figure 6:
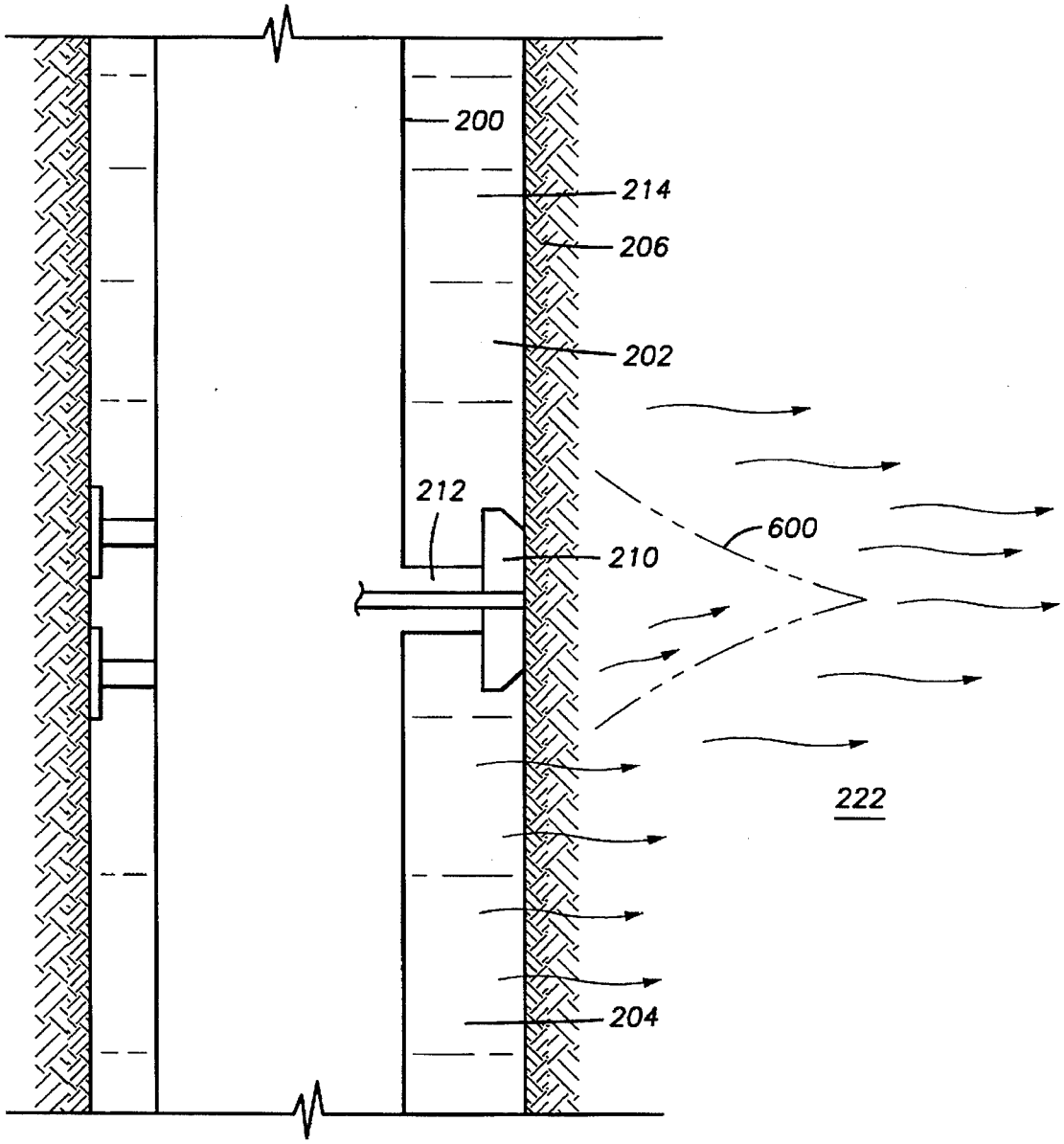
FIG. 6 is a diagram illustrating the disturbed pressure formation distribution in the wellbore and formation due to seepage of drilling fluid through the mudcake around the pad.

However, after the pad 210 seals against the mudcake 206, the pad 210 disturbs the normal pressure distribution in the mudcake 206 and in the formation near the pad 210. As shown in greater detail in FIG. 6, higher hydrostatic pressure inside the wellbore 202 causes wellbore fluids to gradually seep through the mudcake 206 into the formation 222, which is at a lower pressure. As pressure from initially forcing the pad 210 against the mudcake 206 dissipates, fluid seepage through the mudcake 206 creates an area of low pressure 600 in the formation 222 proximate the pad 210. Patterns of exemplary fluid flow through the wellbore 202, mudcake 206, and formation 222 are depicted in FIG. 6 by arrows.

This period of falling pressure, which begins after the time $t_3$ (FIG. 5), contains information indicative of the mudcake's characteristics. In particular, the greatest rate of pressure decrease is especially useful in evaluating the mudcake. Therefore, since the rate of pressure decrease lessens with time, task 410 preferably measures pressure at the probe 212 from the time $t_3$ until the rate of pressure decrease slows to a certain point. This helps to minimize the total time that the tester 200 stays downhole. Pressure may, for example, be measured from time $t_3$ until the pressure sensor 216 no longer indicates changing pressure. Such a determination would, of course, depend upon the sensitivity of the pressure sensor 216. Alternatively, task 410 may wait until the rate-of-pressure-change reaches a selected level, such as 0.01 pound per square inch per second (psi/sec). The detected pressure is shown to reach an acceptable rate at a time 14, corresponding to a pressure level 506. In an exemplary embodiment, the time $t_4$ may occur about 5–10 minutes after the time $t_3$.

If the magnitude of pressure change between the times $t_3$ and $t_4$ is not sufficient, the formation tester 200 may be operated to inject a small volume of fluid through the probe 212 by reversing the path of travel normally used for the piston 218 during a drawdown cycle. The amount of fluid injection, in an illustrative embodiment, may be about i cubic centimeter or less. This small injection may help increase the pressure drop between levels 504 and 506. However, to ensure that the pressure decline between $t_3$ and $t_4$ is truly reflective of the mudcake characteristics, fluid injection is performed gradually and within controlled limits to avoid disturbing the mudcake.

After time $t_4$ is reached, formation fluid is drawn into the tester 200 in task 414 by retracting the pretest piston 218. As the piston 218 retracts, it creates a pressure drop that draws formation fluid into the probe 212, into the flow lines 219*a–b* and into the chamber 220. The volume of fluid in the chamber 220 is typically about 10–20 cubic centimeters, with the flow lines 219*a–b* containing about 100 cubic cenitimeters. The pressure drop associated with the retraction of the piston 218 is referenced in FIG. 5 by reference numeral 508. Retraction of the piston 218 is performed rapidly to insure the mudcake is removed in the process.

The retraction of the piston 218 is stopped in task 416 at a time is (FIG. 5). Also at this time, the master valve 250 may be closed to accelerate the buildup cycle by effectively reducing the flow line volume. In an illustrative embodiment, the piston 218 may be retracted for 10–20 seconds, depending upon the response of the formation 222. When the piston 218 stops retracting, the formation fluid continues to enter the probe 212 until the pressure differential between the chamber 220 and the probe 2 12 is negligible. During this time, the detected pressure builds due to the increasing formation pressure, as shown in FIG. 5 by the pressure increase 510. The detected pressure eventually reaches a steady-state buildup pressure 512 at a time $t_6$. In an exemplary embodiment, this may occur about 100–2000 seconds after the time $t_6$. This steady state buildup pressure is measured by the sensor 216 in task 416 at the time $t_6$.

After task 416, the equalization valve 214 is opened in task 418. This permits the pressure in the probe 212 and the open flow lines to equalize with the hydrostatic pressure of the drilling fluid 204 inside the wellbore 202. The opening of the equalization valve 214 brings the detected pressure up to a level 514. After task 418, the formation tester 200 is released in task 420 by withdrawing the feet 208. Then the formation tester may be removed from the wellbore 202 by retracting the wireline cable 201, after which the routine 400 ends in task 422. Alternatively, the sequence 400 may return to task 404, to re-position the formation tester 200 at a different depth for one or more additional measurements.

Figure 8:
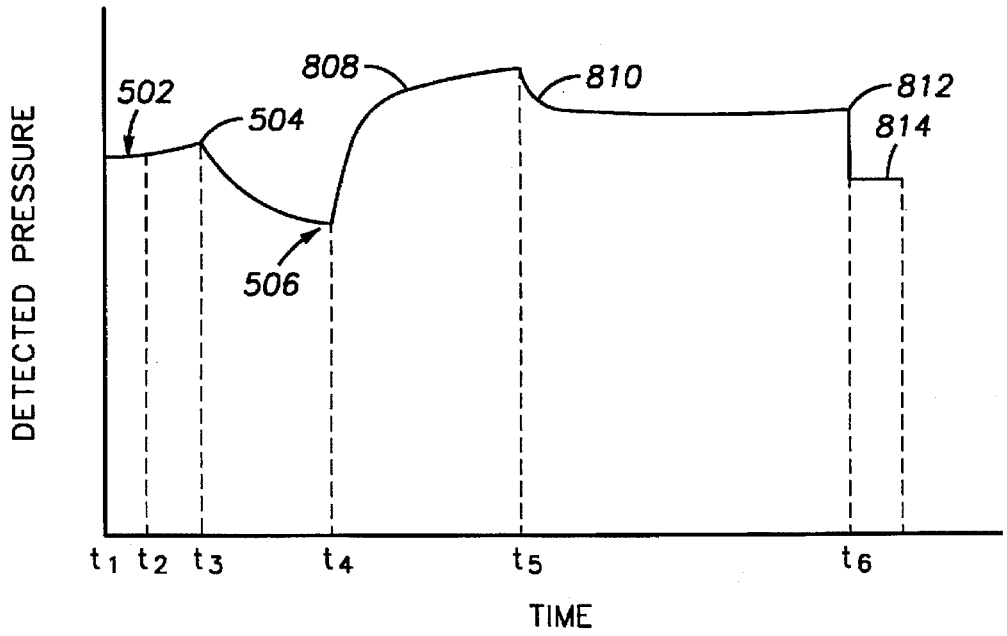
FIG. 8 is a graph illustrating the pressure detected by a formation tester during formation testing conducted in accordance with the routine of the present invention.
Figure 7:
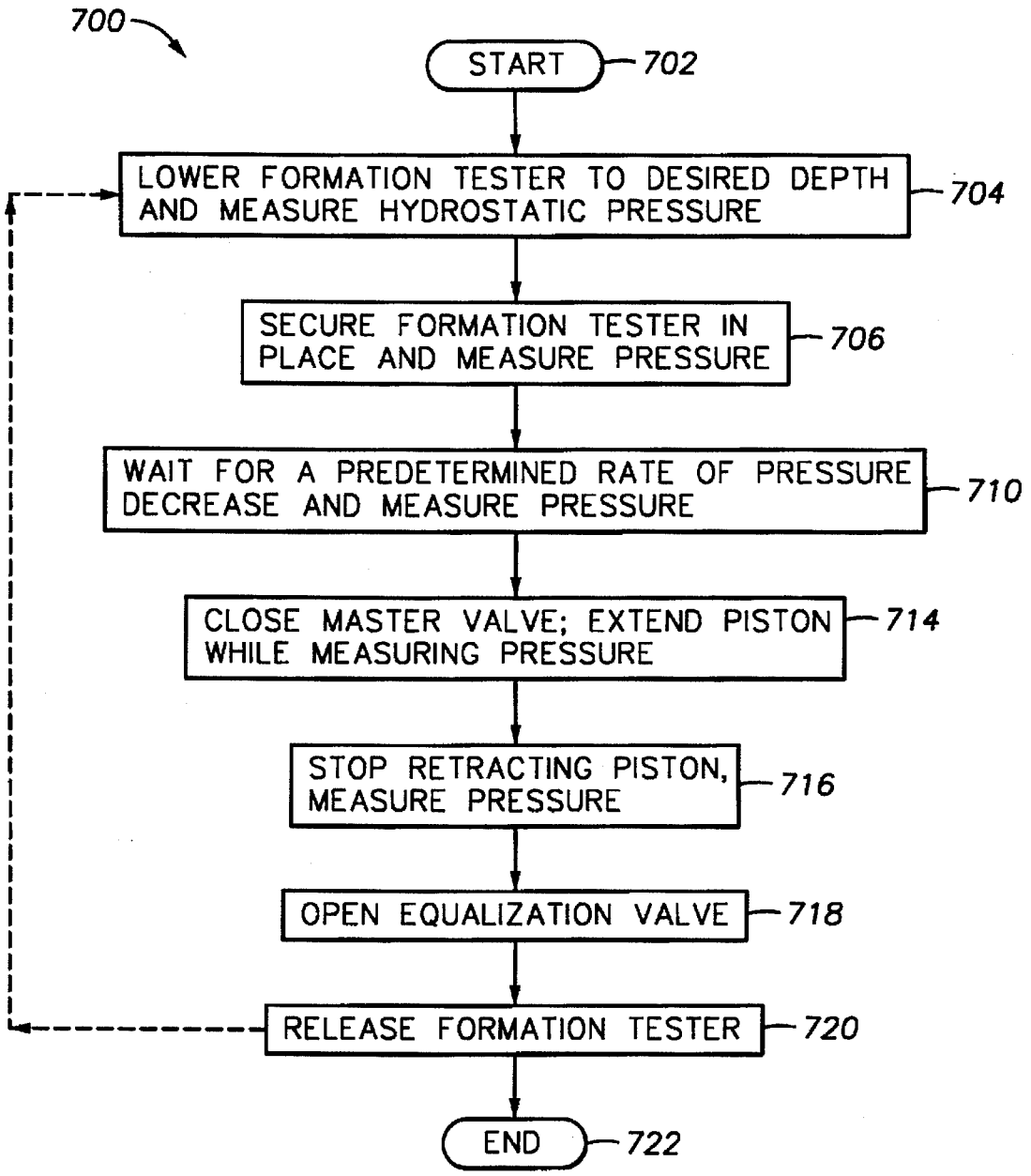
FIG. 7 is a flowchart illustrating a second routine for measuring formation pressure in accordance with the present invention.

As an alternate embodiment, or in addition, to the routine 400, the formation tester 200 may be used to measure formation pressure by injecting fluids into the formation 222. With reference to FIGS. 7 and 8, an exemplary routine 700 will be described,to illustrate an exemplary embodiment of this aspect of the invention. Since tasks 702, 704, 706, and 710 correspond to tasks 402, 404, 406, and 410, description will begin with task 714, wherein fluid is extruded from the chamber 220 by extending the pretest piston 218. Prior to extending the pretest piston 218, if desired, the master 250 may be closed to increase the effectiveness of thee fluid injection into the formation 222.

As the piston 218 extends, it creates a pressure increase that forces Wellbore fluid through the probe 212 and into the formation 222. The pressure increase associated with the extension of the piston 218 is shown in FIG. 8 by reference numeral 808. The extension of the piston is stopped in task 716, at a time is (FIG. 8). The piston 218 may be extended, in an illustrative embodiment, for about 10–20 seconds, depending upon the response of the formation 222. When the piston 218 stops extending, the drilling fluid continues to enter the formation 222 until the pressure differential between the chamber 220 and the formation proximate the probe 212 is negligible. This interval of decreasing pressure is referred to as a "fall-off" period.

More specifically, during the fall-off period, the detected pressure dissipates due to the diffusion of the wellbore fluids into the formation 222, as shown by the pressure decrease 810 (FIG. 8). The detected pressure eventually reaches a steady-state dropoff pressure 812 at a time $t_6$. In an exemplary embodiment, this may occur about 100–2000 seconds after $t_5$. The sensor 216 is used to measure this pressure in task 716. Next, the equalization valve 214 is opened in task 718. This permits the pressure in the probe 212 and the interconnected flow lines to equalize with the hydrostatic pressure of the drilling fluid 204 inside the wellbore 202. The opening of the equalization valve 2 14 is shown in FIG. 8 to occur at the time $t_6$, which brings the detected pressure down to a level 814. After task 718, the formation tester 200 is released by withdrawing the feet 208, and the routine 700 continues in similar fashion to the routine 400.

Figure 9:
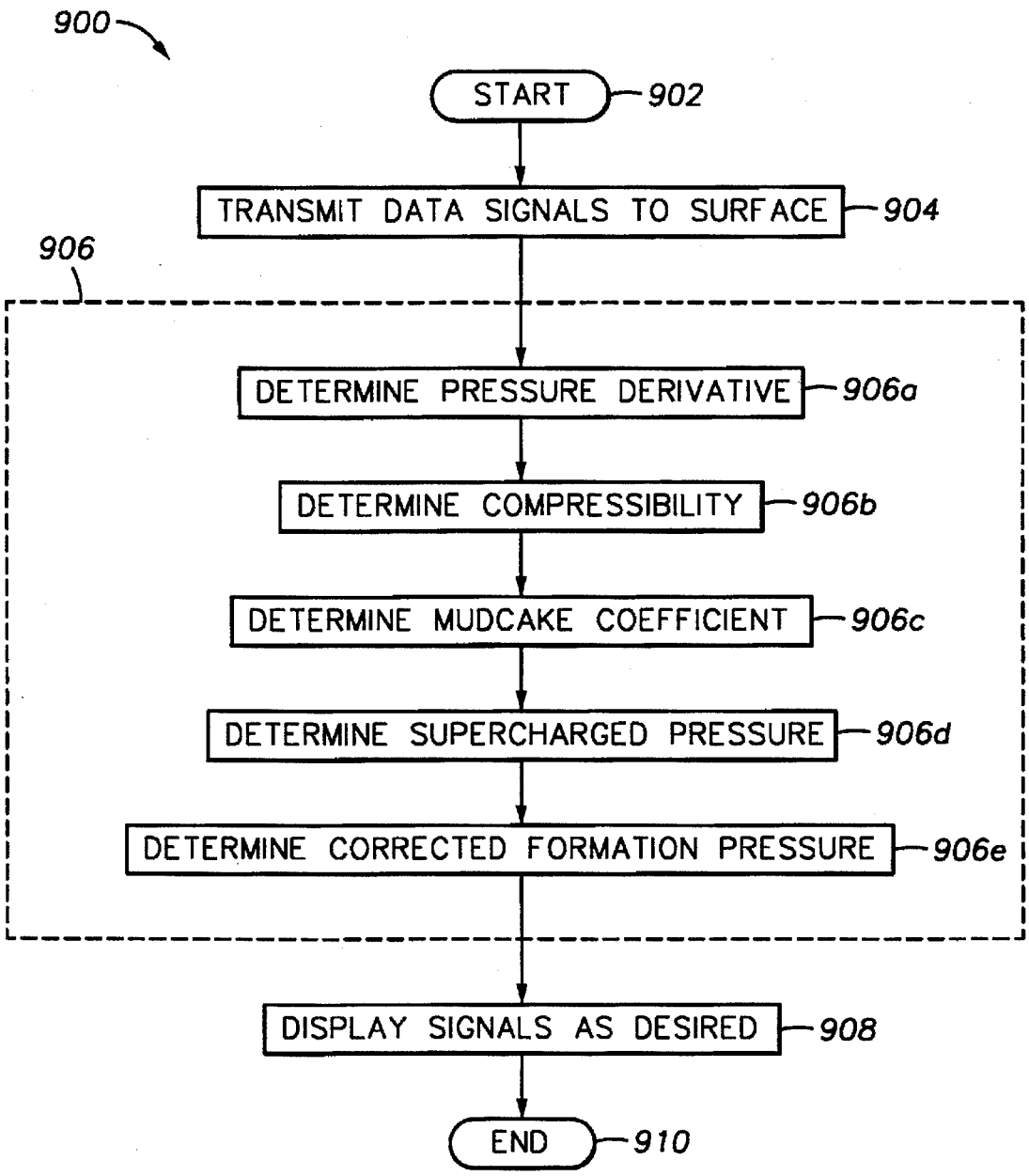
FIG. 9 is a flowchart illustrating steps for performing a surface processing or post-processing routine on data signals produced in accordance with the present invention.

Although not shown in FIGS. 4 and 7 for ease of explanation, the formation tester 200 preferably transmits data signals representative of its measurements to the surface via the wireline cable 201, as depicted by task 904 of the routine 900 illustrated in FIG. 9. In an illustrative embodiment, these data signals may be stored in the formation tester 200 and periodically transmitted to the surface. Alternatively, the data signals may be transmitted to the surface in real time. At the surface, the signals maybe analyzed periodically in a batch, or the signals may be analyzed in "real time" as they arc received at the surface. The surface analysis may be performed, for example, with a digital computer such as an IBM computer, Digital Equipment Corporation computer, or a Unix workstation. In another embodiment, the .signals may be stored in a memory device at the surface and analyzed by a different computer during a "post-processing" routine. Post-processing may also be conducted, for example, using Digital Equipment Corporation computer, Unix workstation, or another suitable computer.

Such analysis, whether performed in real time or in a post-processing routine, is performed in a task 906 as illustrated in FIG. 9. In task 906*a*, the instantaneous pressure derivative between $t_4$ and $t_5$ is determined. Pressure measurements during this period contain information related to the flowline fluid compressibility which is needed to calculate both mudcake and formation permeability. The instantaneous pressure derivative is the rate of change in pressure over time between $t_4$ and $t_5$, and corresponds to Equation 1 (below):

$$\text{pressure derivative} = \frac{\Delta P}{\Delta T} \quad [1]$$

where:

ΔAP=change in pressure during a certain time interval, in pounds per square inch per second; and Δt=the time interval After determining the pressure derivative, the minimum pressure derivative is found, using Equation 2 (below). Since the pressure derivative is negative between $t_3$ and $t_4$, the minimum pressure derivative is understood to be the fastest rate of decreasing pressure.

$$\text{minimum pressure derivative} = \left[\frac{\Delta P}{\Delta t}\right]_{nct} = \min\left[\frac{\Delta P}{\Delta t}\right] \text{(psi/sec)} \quad [2]$$

where:

nct denotes the minimum pressure derivative.

Since the pressure derivative is used in subsequent analysis (below), this analysis provides more accurate data since it inherently reflects the mudcake properties.

Then, in task 906*b*, the in-situ formation compressibility is determined according to Equation 3 (below):

$$c_{fl} = \frac{q}{V_{fl\text{-}d}\left[\frac{\Delta P}{\Delta T}\right]_{nct}} \quad [3]$$

$c_{fl}$=in-situ flowline fluid compressibility, in inverse pounds per square inch;

q=volumetric flow rate, in cubic centimeters per second;

$V_{fl\text{-}d}$=volume of flow lines during drawdown, in cubic centimeters; and t(nct)=time at which minimum pressure derivative occured.

The drawdown flow line volume ($V_{fl\text{-}d}$) is to be used, in Equation 3 when formation testing has been conducted in accordance with the procedure of FIG. 4 (i.e., where the tester 200 performs fluid withdrawal, not injection). However, if formation testing was conducted by fluid injection (e.g., FIG. 7), Equation 3 would use the volume of the flow lines during buildup and the maximum pressure derivative instead of the minimum. Nonetheless, She drawdown and buildup flow line volumes are only different if the master valve 250 is used. Without the master valve 250, the formation tester 200 will only have a single flow line volume.

Assuming that the fluid flowrate is constant, the volumetric flow rate may be determined according to Equation 4 (below):

$$q = \frac{V_{cp}}{t_5 - t_4} \quad [4]$$

where:

$V_{cp}$=volume of chamber 220, in cubic centimeters; and q=volumetric flow rate, in cubic centimeters per second ($cm^3$/sec).

After task 906*b*, task 906*c* may be performed to determine the local mudcake coefficient and formation mobility which is useful in a number of aspects, sucli as estimating mud filtrate loss. The mudcake coefficient and formation mobility is calculated as shown in Equations 5 through 10 below. During the mudcake test portion of the test (See. FIG. 5, 504, 506), Equation 5 is used to determine the (α+β) time constant.

$$P(t) = P_{fm} - (P_{fm} - P_{im})e^{-t/(\alpha+\beta)} \quad (5)$$

Where:

$$\beta = \frac{14{,}696 c_{fl} V_{fl}}{\pi r_p^2 \lambda_{mc} C_{mc}} \quad (6)$$

$$\alpha = \frac{14{,}696 c_{fl} V_{fl}}{2\pi r_p \lambda_f M_f} \quad (7)$$

β=mudcake time constant (see)

α=formation time constant (sec)

$P_{fm}$=mudcake pressure (($P_{fm}$=P(t→∞))

$P_{im}$=mudcake pressure @t=0 (pressure in FIG. 5, 504 at $t_3$)

P=measured pressure in the tool flowline (psi)

$C_{mc}$=mudcake flow constant ($M_{mc}/l_{mc}$, mdarcy/cp-cm)

$M_{mc}$=mudcake mobility ($K_{mc}$/m, mdarcy/cp)

$M_f$=formation mobility ($K_f$/m, mdarcy/cp)

$K_{mc}$=mudcake permeability (mdarcy)

$l_{mc}$ mudcake tickness (length, cm)

m viscosity of flow lie fluid (cp)

$c_{fl}$ filtrate compressibility (l/psi)

$V_{fl}$ flow line volume ($cm^3$)

$\lambda_{mc}$ mudcake borehole shape factor (dimensionless)

$\lambda_f$ formation borehole shape factor (dimensionless)

The shape factors are determined from numerical simulation, typically a finite clement model analysis. Typically the shape factors remain constant over a wide range of forehole conditions.

Standard regression techniques can be used to solve for the time constant (α+β) in equation 5 from times $t_3$ to $t_4$ in FIG. 5 and FIG. 8. Also a similar equation can be used to solve for the time constant from times $t_4$ through is in FIG. 8 in regard to formation pressure measurements made during fluid injection.

During the drawdown period (see FIG. 5, 508) the mudcake is removed. During buildup time period (see FIG. 5, 510) Equation 8 can be used to determine the formation time constant (α) as well as the sandface initial pressure ($P_{si}$).

$$P(t) = P_{si} - (P - P_{bu})e^{-t/\alpha} \quad (8)$$

Where:

$P_{bu}$=initial buildup pressure @t=0 (pressure in FIG. 5 at $t_5$)

Now the β time constant can determined and used to find the mudcake flow constant from Equation 6:

$$C_{mc} = \frac{14{,}696 c_{fl} V_{fl}}{\pi r_p^2 \lambda_{mc} \beta} \quad (9)$$

The α time constant can be used to determine the formation, mobility from Equation 7:

$$M_f = \frac{14{,}696 c_{fl} V_{fl}}{2\pi r_p \lambda_f \beta} \quad (10)$$

After task 906*c*, task 906*b* determines the supercharged formation pressure, as shown in Equations 11 through 15. To determine the supercharge pressure it is necessary to estimate the undisturbed sandface pressure under the mudcake (see FIG. 6). As previously mentioned the packer element creates a disturbance in the near well bore. This is caused by the invention pad element completely blocking the mud seepage around the probe. This disturbance can be estimated by using the following relationship.

$$S_m = \left(\frac{M_f}{\lambda_e r_e}\right)\frac{(P_{su}-P_{si})}{14696} \quad (11)$$

Where $P_{su}$ undisturbed sandface pressure (psi)

$r_e$ packer element radius (era)

$\lambda_e$ packer element shape factor (dimensionless)

The packer element shape factor can be determined both analytically or numerically. The analytical solution for a potential flow around a circular flat disk can be used and should be fairly accurate but numerical results are preferred.

A second relationship between the mud seepage velocity $S_m$ is needed to determine the undisturbed sandface pressure:

$$S_m = \frac{C_{mc}(P_{mh}-P_{su})}{14696} \quad (12)$$

Where:

$P_{mh}$=borehole mud hydrostatic pressure (psi)

Using Equations 11 and 12 the undisturbed sandface pressure can be estimated:

$$P_{su} = \frac{P_{mh} + \left(\frac{M_f}{\lambda_e r_e C_{mc}}\right)P_{si}}{1 + \left(\frac{M_f}{\lambda_e r_e C_{mc}}\right)} \quad (13)$$

This pressure is now used in Equation 14 to determine the-supercharge differential pressure:

$$\Delta P_{sc} = P_{su} - P_f = \left[\frac{r_w C_{mc}(P_{mh}-P_{su})}{M_f}\right]\ln\left[\frac{r_f}{r_w}\right] \quad (14)$$

And finally the estimate of the actual formation pressure is obtained by subsufiting equations 9, 10 and 13 into equation 14 which yields:

$$P_f = \frac{2\alpha\lambda_f\lambda_e r_e P_{mh} + \beta\lambda_{mc} r_p P_{si} - 2\alpha\lambda_f r_w(P_{mh}-P_{si})\ln(r_f/r_w)}{2\alpha\lambda_f\lambda_e r_e + \beta\lambda_{mc} r_p} \quad (15)$$

Equation 15 gives the actual formation pressure and does not require permeabilities or fluid properties to be estimated. Only the time constants for the mudcake .(b) and formation (a) are needed along with the tester and formation dimensions ($r_p$, $r_e$, $r_w$, $r_f$) and shape factors ($l_{mc}$, $l_f$, $l_e$) Mudcake and formation properties are useful and can be estimated using equations 9 and 10.

After task **906*d*, task 906*e* determines the corrected formation pressure, by using Equation 15, then, the corrected formation pressure may be displayed in task 908. Display may be accomplished using a cathode ray tube ("CRT") monitor, a film recorder, computer printout, computer monitor, or another suitable device. After task 908, the routine ends in task 910**.

CONCLUSION

The present invention provides its users with a number of advantages. For instance, the invention provides more accurate formation pressure measurements by accounting for the mudcake's permeability. Additionally, the invention provides its users with an accurate measurement of in situ fluid compressibility, in contrast to previous techniques. Along these lines, the fluid compressibility measurement of the present invention may be advantageously used to determine various estimates of formation mobility, such as drawdom mobility and buildup mobility. Additionally, the improved measurements obtained in accordance with the present invention may be used to more accurately evaluate the mudcake, e.g., by providing a mudcake coefficient of improved precision. Also, the present invention may be especially useful to accurately measure formation characteristics in difficult formation areas such as supercharged regions. Moreover, the fluid compressibility of the invention may be useful in more accurately performing other techniques of analyses, such as generating Homer plots or spherical buildup plots.

While there have been shown what are presently considered to be preferred embodiments of the invention, it will be apparent to those skilled in the art that various changes and modifications can be made herein without departing from the scope of the invention as defined by the appended claims.

The invention is claimed is:

1. A method for measuring characteristics of materials in a wellbore of an earth formation, said wellbore having an inner wall covered by a mudcake, said method comprising the steps of:

(a) disposing a formation pressure tester into said wellbore, said tester having a probe having an isolation pad attached thereto;

(b) disposing said probe and isolation pad against said mudcake while maintaining said mudcake substantially intact in the wellbore area beneath Said isolation pad;

(c) measuring fluid pressure at said probe to collect data correlative to characteristics of said mudcake;

(d) inducing a pressure differential between said tester and said formation, drawing fluid from said formation into said tester through said probe while avoiding substantial damage of said mud cake, and measuring fluid pressure at said probe;

(e) terminating said induced pressure differential, continuing to draw fluid from said formation into said tester and measuring fluid pressure at said probe; and (f) determining an in situ fluid compressibility, formation pressure and formation permeability.

2. The method, as set forth in claim 1, wherein step (a) comprises the step of:

lowering said tester into said wellbore by a wireline.

3. The method, as set forth in claim 1, wherein step (b) comprises the steps of:

extending said probe against said mudcake; and extending at least one foot being coupled of said tester against said mudcake.

4. The method, as set forth in claim 1, step (b) comprises the step of:

sealing said probe to said mudcake.

5. The method, as set forth in claim 4, wherein said probe comprises a pad coupled thereto and wherein said step of sealing comprises the step of pressing said pad onto said mudcake.

6. The method, as set forth in claim 1, wherein step (b) causes said measured fluid pressure to increase for a first period of time and wherein said measured fluid pressure decreases for a second period of time.

7. The method, as set forth in claim 6, wherein said probe to collects data correlative to characteristics of said mudcake as said fluid pressure decreases during said second period of time.

8. The method, as set forth in claim 1, wherein step (c) comprises the steps of:

transmitting said measured fluid pressure data to a control; and initiating step (d) when said data conforms to predetermined condition.

9. The method, as set forth in claim 8, wherein said said predetermined condition is said measured fluid pressure approximating a constant value.

10. The method as set forth in claim 8, wherein said the step of:

said predetermined condition is said measured fluid pressure exhibiting a predetermined rate of change.

11. The method, as set forth in claim 8, wherein said predetermined condition is measuring fluid pressure for a period in the range of 5 to 10 minutes.

12. The method, as set forth in claim 1, wherein step (d) comprises the step of:

retracting a piston in a cylinder chamber of a hydraulic system coupled to said probe to initiate drawing fluid from said formation into said tester through said probe.

13. The method, as set forth in claim 12, wherein said step of retracing comprises the step of retracting said piston at a rate sufficient to remove said mudcake disposed between said probe and said formation.

14. The method, as set forth in claim 1, wherein step (e) comprises the step of:

measuring fluid pressure at said probe until said pressure ceases to increase.

15. The method of claim 1, wherein determining formation pressure includes determining a sandface initial pressure and a supercharge pressure.

16. The method of claim 7, whereupon if said data relative to said fluid pressure decrease does not meet a predetermined criteria, fluid is injected from said tester into said formation and step (c) is repeated.

17. A method for determining characteristics of a subterranean earth formation penetrated by a wellbore, the wellbore having a mudcake on an inner wall, the steps comprising:

(a) disposing a formation tester in said wellbore, said formation tester having a probe and an isolation pad attached thereto;

(b) sealingly disposing said probe and said isolation pad against said mudcake, while maintaining said mudcake substantially intact in the wellbore area beneath said isolation pad;

(c) measuring fluid pressure at said probe;

(d) injecting a fluid from said tester into said mudcake through said probe where said fluid pressure measurement does not meet a first predetermined criteria and repeating step (c);

(e) inducing a pressure differential between said tester and said formation, drawing fluid from said formation into said tester through said probe, while avoiding substantial damage to said mudcake, and measuring the pressure of said fluid at said probe;

(f) terminating said induced pressure differential, continuing to draw fluid from said formation into said tester, and continuing to measure fluid pressure at said probe until a second predetermined criteria is met; and (g) determining said formation pressure and permeability.

18. The method of claim 17, wherein step (g) further includes determining an in situ fluid compressibility, an initial sandface pressure and a supercharge pressure, said formation pressure being a function of said initial sandface pressure and said supercharge pressure.

19. The method of claim 17, wherein step (c) includes measuring a pressure increase following step (b), followed by a pressure decrease.

20. The method of claim 19, wherein said first predetermined criteria is a predetermined pressure drop over a predetermined period of time.

21. The method of claim 19, wherein said first predetermined criteria is predetermined rate of pressure change.

22. A method for determining characteristics of a subterranean earth formation penetrated by a wellbore, the wellbore having a mudcake on an inner wall, the steps comprising:

(a) disposing a formation tester in said wellbore, said formation tester having a probe and an isolation pad attached thereto;

(b) sealingly disposing said probe and said isolation pad against said mudcake, while maintaining said mudcake substantially intact in the wellbore area beneath said isolation pad, and measuring an increase in fluid pressure at said probe;

(c) measuring a fluid pressure decrease at said probe for a predetermined time period and comparing said measured pressure decrease against a first predetermined criteria;

(d) injecting fluid from said tester into said mudcake through said probe where said measured pressure decrease does not meet said first predetermined criteria and repeating step (c);

(e) inducing a pressure differential between said tester and said formation, drawing fluid from said formation into said tester through said probe, while avoiding substantial damage to said mudcake, and measuring the pressure of said fluid at said probe;

(f) terminating said induced pressure differential, continuing to draw fluid from said formation into said tester, and continuing to measure fluid pressure at said probe until a second predetermined criteria is met; and (g) determining said formation pressure and permeability.

23. The method of claim 22, wherein said first predetermined criteria is a predetermined change in pressure.

24. The method of claim 22, wherein said first predetermined criteria is a predetermined rate of pressure change.

* * * * *